US008480268B2

(12) United States Patent
Wilson et al.

(10) Patent No.: US 8,480,268 B2
(45) Date of Patent: Jul. 9, 2013

(54) ELECTRICAL BOX AND BALLAST MOUNTING ASSEMBLY FOR RETROFITTING RECESSED LIGHTING FIXTURES

(75) Inventors: Carl W. Wilson, Lyman, SC (US); Richard L. D'Andrea, Simpsonville, SC (US); Brad Rodeghiero, Simpsonville, SC (US)

(73) Assignee: Hubbell Incorporated, Shelton, CT (US)

( * ) Notice: Subject to any disclaimer, the term of this patent is extended or adjusted under 35 U.S.C. 154(b) by 339 days.

(21) Appl. No.: 12/858,683

(22) Filed: Aug. 18, 2010

(65) Prior Publication Data

US 2012/0044704 A1 Feb. 23, 2012

(51) Int. Cl.
*F21V 15/00* (2006.01)

(52) U.S. Cl.
USPC ..... 362/365; 362/364; 362/368; 362/371; 220/3.7

(58) Field of Classification Search
USPC ..... 362/362, 364–366, 368, 370–371, 362/374–375; 220/3.2–3.9
See application file for complete search history.

(56) References Cited

U.S. PATENT DOCUMENTS

| | | | | |
|---|---|---|---|---|
| 2,423,757 | A | 7/1947 | Dedge | |
| 2,929,920 | A | 3/1960 | Feig | |
| 3,091,687 | A | 5/1963 | Papsdorf | |
| 3,286,090 | A * | 11/1966 | Brown | 362/366 |
| 3,327,984 | A | 6/1967 | Rennie | |
| 3,700,885 | A | 10/1972 | Bobrick | |
| 4,053,082 | A | 10/1977 | Ullman | |
| 4,274,615 | A | 6/1981 | Chan et al. | |
| 4,408,262 | A | 10/1983 | Kusmer | |
| 5,031,084 | A | 7/1991 | Russo et al. | |
| 5,746,507 | A * | 5/1998 | Lee | 362/365 |
| 5,857,766 | A * | 1/1999 | Sieczkowski | 362/365 |
| 5,957,574 | A * | 9/1999 | Hentz et al. | 362/365 |
| 6,004,011 | A * | 12/1999 | Sieczkowski | 362/365 |
| 6,082,878 | A * | 7/2000 | Doubek et al. | 362/365 |

(Continued)

FOREIGN PATENT DOCUMENTS

JP 5-28819 2/1993

*Primary Examiner* — Anne Hines
*Assistant Examiner* — Jose M Diaz
(74) *Attorney, Agent, or Firm* — Garrett V. Davis; Mark S. Bicks; Alfred N. Goodman

(57) ABSTRACT

A retrofit luminaire assembly is provided for retrofitting a mounting frame such as a plaster frame or other recessed lighting assembly without the need to remove the existing plaster frame. The retrofit assembly includes a mounting ring that can support a replacement electrical junction box and the replacement luminaire. The electrical junction box is attached to an adjustable assembly so that the electrical box can be positioned in a number of locations on the mounting ring. The assembly allows adjustment of the electrical box in a vertical direction, horizontal direction and in a rotational direction with respect to the plane of the plaster frame. The mounting ring is inserted through the opening in the plaster frame and secured to the plaster frame by an attachment member that engages the top face of the plaster frame. The attachment member can include a plate coupled to the mounting ring to form two outwardly extending arms. The plate is axially adjustable with respect to the mounting ring to clamp the plaster frame between the plate and the bottom flange of the mounting ring. In another embodiment, the attachment member has a hook-like end that engages a bottom surface of the mounting frame.

37 Claims, 11 Drawing Sheets

U.S. PATENT DOCUMENTS

| | | | | |
|---|---|---|---|---|
| 6,561,670 | B1 * | 5/2003 | Jongewaard et al. | 362/147 |
| 6,659,627 | B2 | 12/2003 | Caluori | |
| 7,438,433 | B1 | 10/2008 | Steadman et al. | |
| 7,585,084 | B2 | 9/2009 | Kinnune et al. | |
| 7,614,769 | B2 | 11/2009 | Sell | |
| 2005/0227536 | A1 * | 10/2005 | Gamache et al. | 439/607 |
| 2009/0135615 | A1 | 5/2009 | Caluori | |
| 2009/0196053 | A1 | 8/2009 | Ziobro et al. | |
| 2009/0231861 | A1 | 9/2009 | Wedekind | |
| 2009/0231862 | A1 | 9/2009 | Seo | |
| 2009/0290343 | A1 * | 11/2009 | Brown et al. | 362/235 |

* cited by examiner

ELECTRICAL BOX AND BALLAST MOUNTING ASSEMBLY FOR RETROFITTING RECESSED LIGHTING FIXTURES

FIELD OF THE INVENTION

The present invention is directed to a mounting assembly for a ballast and electrical box in a recessed lighting assembly. The invention is particularly directed to a lighting assembly for retrofitting a recessed light fixture where the lighting assembly has a ballast and electrical box that can be adjusted to different positions to accommodate the space above the light fixture.

BACKGROUND OF THE INVENTION

Recessed lighting fixtures are typically installed behind a frame or above a ceiling which limits the accessibility to the user. It can be costly and time consuming to repair or replace lamp components such as ballasts, transformers and other components that are mounted to the lighting assembly. Typically, modifications to an installed lighting assembly require removal of the assembly or various components from the ceiling.

Recently, there has been an increased interest in retrofitting existing recessed light assemblies. Often the retrofit is to upgrade the lighting components and to replace the existing components with more energy efficient lamps or components without the need to remove the ceiling and the main support structure for the light assembly.

Retrofitting generally requires that the lamp and lamp socket be removed from the support structure. The replacement lamps often require the replacement of a ballast that is mounted within the wall or ceiling cavity and can be difficult to access without removing the support structure or removing the ceiling tiles or cutting access openings in the wall or ceiling. Various devices have been constructed for mounting lighting fixtures to a ceiling or to a support after the support is installed. One example is disclosed in U.S. Pat. No. 4,274,615 to Chan et al. This device includes an attachment clamp with a threaded adjustment member. A locking finger engages the bottom surface of the ceiling. The threaded adjustment member clamps the locking finger against the ceiling.

An example of a conversion system is disclosed in U.S. Pat. No. 7,614,769 to Sell. This patent discloses an LED conversion for use in a recessed ceiling fixture. The system uses the lamp can and the ceiling panel. A housing having a can with apertures and an electrical socket are mounted in the ceiling. A lamp fitting having a plurality of LEDs is attached to the can.

Numerous other devices have been constructed for mounting the electrical components and lamps in the ceiling. Examples of such devices are disclosed in U.S. Pat. No. 4,408,262 to Kusmer, U.S. Pat. No. 6,659,627 to Caluori, U.S. Pat. No. 4,053,082 to Ullman, U.S. Pat. No. 7,438,433 to Steadman et al., U.S. Patent Publication No. 2009/0196053 to Ziobro et al., and U.S. Patent Publication No. 2009/0231862 to Seo.

Although these devices have been satisfactory for their intended needs, there is a continuing need in the industry for an improved device.

SUMMARY OF THE INVENTION

The present invention is directed to a lighting assembly for mounting to a support structure. In particular, the invention is directed to a lighting assembly for retrofitting a recessed light fixture without the need to remove the components of the lighting fixture from the ceiling or wall.

Accordingly, one aspect of the invention is to provide a lighting assembly that can be used to retrofit a recessed lighting fixture without the need to remove the existing fixture and where the retrofit lighting assembly is coupled to the existing plaster frame or ceiling structure.

Another aspect of the invention is to provide a lighting assembly that can be attached directly to a plaster frame or other support structure for a lighting fixture without the need to remove the ceiling, cut access openings or the need to remove the support structure from the ceiling.

A further aspect of the invention is to provide a lighting assembly for retrofitting a ceiling fixture where the assembly has a dimension and shape that can be inserted through the opening in the recessed lighting fixture or plaster frame and attached to the existing light fixture or plaster frame in the ceiling cavity.

Another aspect of the invention is to provide a lighting assembly for retrofitting a recessed light fixture, the assembly having a retrofit ballast and electrical box that has a dimension to pass through the opening in the recessed light fixture. The electrical box and ballast are attached to the assembly to be adjustable to different positions to avoid obstructions in the recessed light fixture.

A still further aspect of the invention is to provide a lighting assembly for retrofitting a recessed lighting fixture where the assembly includes an adjustable electrical box. The position of the electrical box can be adjusted in multiple directions to avoid obstructions in the wall or ceiling. In one embodiment, the electrical box is attached to a mounting structure and can be adjusted in a vertical first direction and in at least one second direction perpendicular to the first direction. In another embodiment, the electrical box is pivotally connected to the mounting structure.

The features of the invention include a retrofit lighting assembly that is attached to a ceiling pan or plaster frame of a recessed light fixture without requiring the removal or replacement of the plaster frame. The assembly can include a ring that fits into the opening of the plaster frame and attached to the plaster frame. A bracket is attached to the ring for supporting a replacement electrical box. The bracket is adjustable around the perimeter of the ring and provides adjustment of the electrical box in a vertical direction, a lateral direction, a radial direction and a pivotable motion with respect to the ring.

The lighting assembly of the invention is adapted for retrofitting an existing lighting fixture mounted in a ceiling or wall. The lighting assembly can be attached directly to the support structure without modifying the support structure. The retrofit assembly of the invention can be used to install compact fluorescent lights (CFL) or LED lights to a light fixture without the need to remove the support structure of the light fixture. The assembly can support replacement lamps in a horizontal or vertical orientation.

The lighting assembly in one embodiment has a mounting ring that fits into the opening in the ceiling and the support structure. The ring has an annular side wall that extends through the opening and a flange for contacting the outer surface of the ceiling or plaster frame. An attachment member having the shape of a bar is attached to the ring for clamping against the top of the support structure to secure the ring in place. An electrical junction box mounted on a support arm is attached to the mounting ring. The electrical connections are made between the power source, the junction box and the luminaire. A reflector supporting the replacement lamp and socket is inserted into the ring and attached thereto by fasteners.

In one embodiment of the invention, the retrofit assembly includes a split, two-part mounting ring. Each part of the mounting ring is passed through the opening in the plaster frame and positioned on the top surface of the plaster frame around the opening. An attachment member having a hook-like end is hooked onto a bottom edge of the collar of the plaster frame and coupled to the respective portion of the mounting ring.

A further aspect of the invention is to provide a retrofit lighting assembly having a mounting ring for coupling to an existing plaster frame and a retrofit luminaire assembly coupled to the mounting ring.

The invention is further directed to a method of retrofitting a recessed lighting assembly. The existing lamp and reflector can be removed from the ceiling or the support structure of the lighting assembly. The original electrical box and ballast can be removed or moved to a location within the ceiling where it will not interfere with the installation of the retrofit lighting assembly. The retrofit electrical box and ballast are connected to the power source and attached to a mounting ring. The mounting ring is then positioned in the opening of the ceiling or the support structure. Alternatively, the mounting ring can be mounted to the support structure and then the electrical box and ballast can be attached to the ring. A replacement reflector, socket and lamp are then inserted into the ring and secured to the ring by suitable fasteners.

The various features and aspects of the invention are basically attained by providing a lighting fixture assembly comprising a mounting frame adapted to be coupled to a ceiling support. The mounting frame has a downwardly facing bottom portion with an opening. A luminaire is mounted with respect to the mounting frame for projecting light downwardly through the opening. An electrical box assembly is provided including an electrical box and an adjustable mounting bracket. The electrical box assembly has a dimension adapted to pass through the opening and to mount to the mounting frame. The mounting bracket is adjustable in a first vertical direction with respect to a plane of the bottom portion and is adjustable in a second direction transverse to the first direction.

The various aspects of the invention are further attained by providing a lighting fixture assembly comprising a mounting frame adapted to be coupled to a support and having an opening therein. A luminaire is mounted with respect to the mounting frame for projecting light through the opening. An adjustable mounting bracket is coupled to the mounting frame. An electrical box is coupled to the adjustable bracket. The electrical box and adjustable bracket are adapted for adjusting the position of the electrical box with respect to the opening in a first direction away from the opening and in a direction substantially perpendicular to the first direction.

The various features of the invention are also attained by providing a lighting fixture assembly comprising a mounting frame adapted to be coupled to a support. The mounting frame has an opening and a luminaire mounted with respect to the mounting frame and positioned to project light downwardly through the opening. An electrical box assembly is adapted for attachment to the mounting frame. The electrical box assembly is adapted to be adjustable in at least two dimensions with respect to the mounting frame.

The features of the invention are still further attained by providing a method of retrofitting a lighting assembly having a mounting frame coupled to a support and a luminaire for projecting light through an opening in the mounting frame. The method comprises the steps of removing the luminaire from the mounting frame and inserting an electrical box assembly through the opening in the mounting frame and attaching the electrical box assembly to the mounting frame. The electrical box assembly includes a mounting bracket and an electrical box coupled to the mounting bracket. The height and angular position of the electrical box is adjusted in a selected position with respect to the mounting frame. A replacement luminaire is mounted above the mounting frame and operatively connects the replacement luminaire to the electrical box.

These and other aspects of the invention will become apparent from the following detailed description of the invention, which in conjunction with the annexed drawings, disclose various embodiments of the invention.

BRIEF DESCRIPTION OF THE DRAWINGS

The following is a brief description of the drawings, in which.

DETAILED DESCRIPTION OF THE INVENTION

Figure 1:
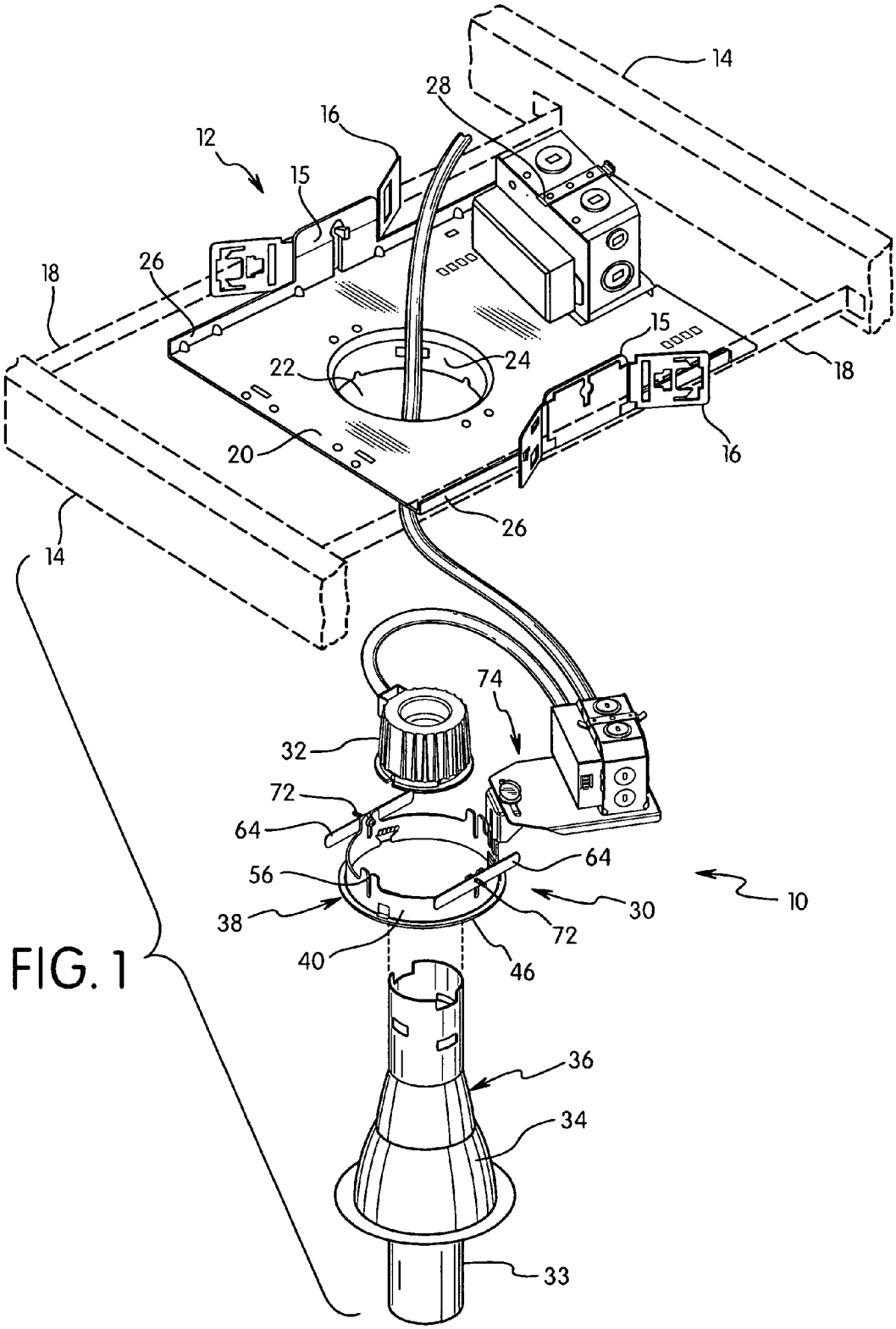
FIG. 1 is a perspective view of the retrofit lighting assembly and plaster frame in a first embodiment of the invention.

The present invention is directed to a lighting assembly for retrofitting an existing lighting assembly mounted in a wall or ceiling. In particular, the invention is directed to a retrofit lighting assembly that can be attached to the existing support structure of a lighting assembly without the need to remove the existing lighting assembly or remove the components of the lighting assembly.

Referring to the drawings, lighting assembly 10 is adapted for mounting to an existing lighting assembly having a mounting frame or other support structure such as a plaster frame 12. Alternatively, the lighting assembly 10 can be mounted in a hole or opening in a ceiling.

The invention is particularly suitable for retrofitting existing recessed lighting fixtures with CFL or LED lighting devices without the need to disassemble or remove the existing fixtures. Plaster frame 12 in the embodiments of the present invention is an existing plaster frame or ceiling pan that is recessed in a ceiling and is intended to be retrofitted by the lighting assembly 10 of the present invention. The lighting assembly can be attached to the plaster frame without the need to remove or modify the plaster frame. Plaster frame 12 defines a support for a luminaire and is mounted to a ceiling support such as spaced apart ceiling joists 14 as shown in FIG. 1. Plaster frame 12 includes plates 15 and mounting brackets 16 on opposite sides for receiving hanger bars 18 which are attached to the ceiling joists in the embodiment shown. Hanger bars 18 can be a commercially available hanger bar assembly that is attached to the ceiling joist 14 in a standard manner.

In the embodiment shown, plaster frame 12 has a substantially flat bottom 20 with an opening 22 for the luminaire and for directing light downwardly from the bottom 20 through the opening 22. The opening is circular to accommodate the luminaire and reflector. A downwardly extending collar 24 extends from the bottom 20 through the opening in the ceiling material 25. The opposite sides of bottom 20 include upwardly extending flanges 26 for attaching to the mounting brackets 16. Opening 22 and collar 24 support a reflector 34 and the luminaire 36 for directing light downwardly to the target area.

Plaster frame 12 in the embodiment illustrated includes an existing electrical box 28 mounted to the top surface of the bottom 20 in a conventional manner. Lighting assembly 10 of the invention is adapted for retrofitting the plaster frame 12 without the need to remove the plaster frame from the ceiling and without the need to remove the existing luminaire and electrical box 28. The existing luminaire can be removed from the plaster frame 12, if desired, and the electrical connection between the luminaire and the electrical box 28 can be removed. In the embodiment shown in FIG. 1, the existing luminaire has been removed and is not shown for simplicity. It is not necessary to remove the existing electrical box 28 although the existing electrical box 28 can be removed, if desired. The existing cable connection between the electrical box and the socket of the luminaire can also be moved aside within the ceiling cavity without the need to remove the socket and cable.

Referring to FIGS. 1-11, lighting assembly 10 in a first embodiment is a complete and self-contained lighting assembly adapted for retrofitting a mounting frame such as plaster frame 12 or for mounting in an opening in the ceiling. Lighting assembly 10 includes a mounting assembly 30 for receiving and supporting a luminaire 36 that includes lamp socket 32, a lamp 33 and reflector 34. Luminaire 36 preferably has a suitable shape and size to accommodate the plaster frame 12. Lighting assembly 10 can be used to replace damaged parts of the existing luminaire or to upgrade the existing luminaire to more efficient lighting. In one embodiment of the invention, lighting assembly 10 is a LED lighting assembly or compact fluorescent light for upgrading the existing luminaire.

Mounting assembly 30 in the first embodiment of the invention includes a mounting ring 38 having a dimension for inserting into the opening 22 of plaster frame 12 or into the opening in the ceiling. Mounting ring 38 in the embodiment shown has a substantially circular side wall 40 with a top edge 42 and a bottom edge 44. A radial flange 46 extends outwardly from the bottom edge 44. Flange 46 has a dimension to engage the bottom edge of the plaster frame or the bottom surface of the ceiling. A plurality of holes 48 are provided at or near the intersection between the side wall 40 and flange 46 for receiving a clip 50 as shown in FIG. 3 for coupling with the luminaire 36 and attaching the luminaire 36 to the mounting ring 38.

Clip 50 includes a tab 52 that extends through the hole 48 in ring 38. Upwardly extending fingers 54 are angled inwardly and positioned within the circular side wall 40 for frictionally engaging the replacement reflector 34 and supporting the reflector and luminaire 36 within the ring 38.

Figure 3:
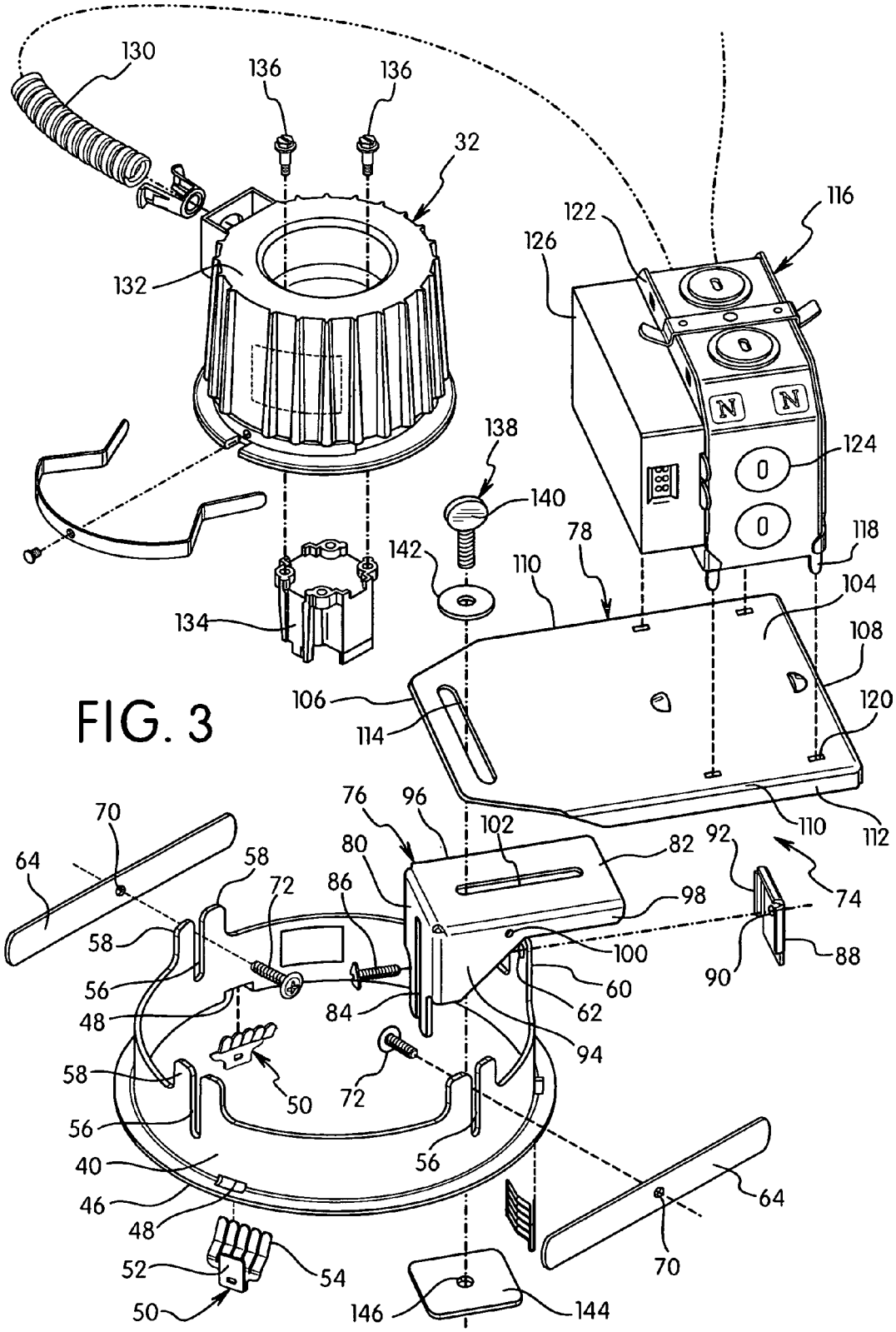
FIG. 3 is an exploded view of the retrofit lighting assembly of FIG. 1.

Referring to FIG. 3, side wall 40 of mounting ring 38 includes a plurality of longitudinal slots 56 extending axially with respect to side wall 40. In the embodiment illustrated, the top edge 42 includes upwardly extending tabs 58 that are spaced apart a distance to define the slots 56. Tabs 58 extend axially upward with respect to the top edge 42 of side wall 40. Preferably, tabs 58 lie in the same axial plane of the side wall 40.

A mounting flange 60 extends upwardly from side wall 40 in the plane of the side wall. An aperture 62 is provided in mounting flange 60 for receiving a mounting screw. The mounting flange 60 has a dimension sufficient to support the replacement electrical junction box assembly as discussed in detail herein.

Figure 2:
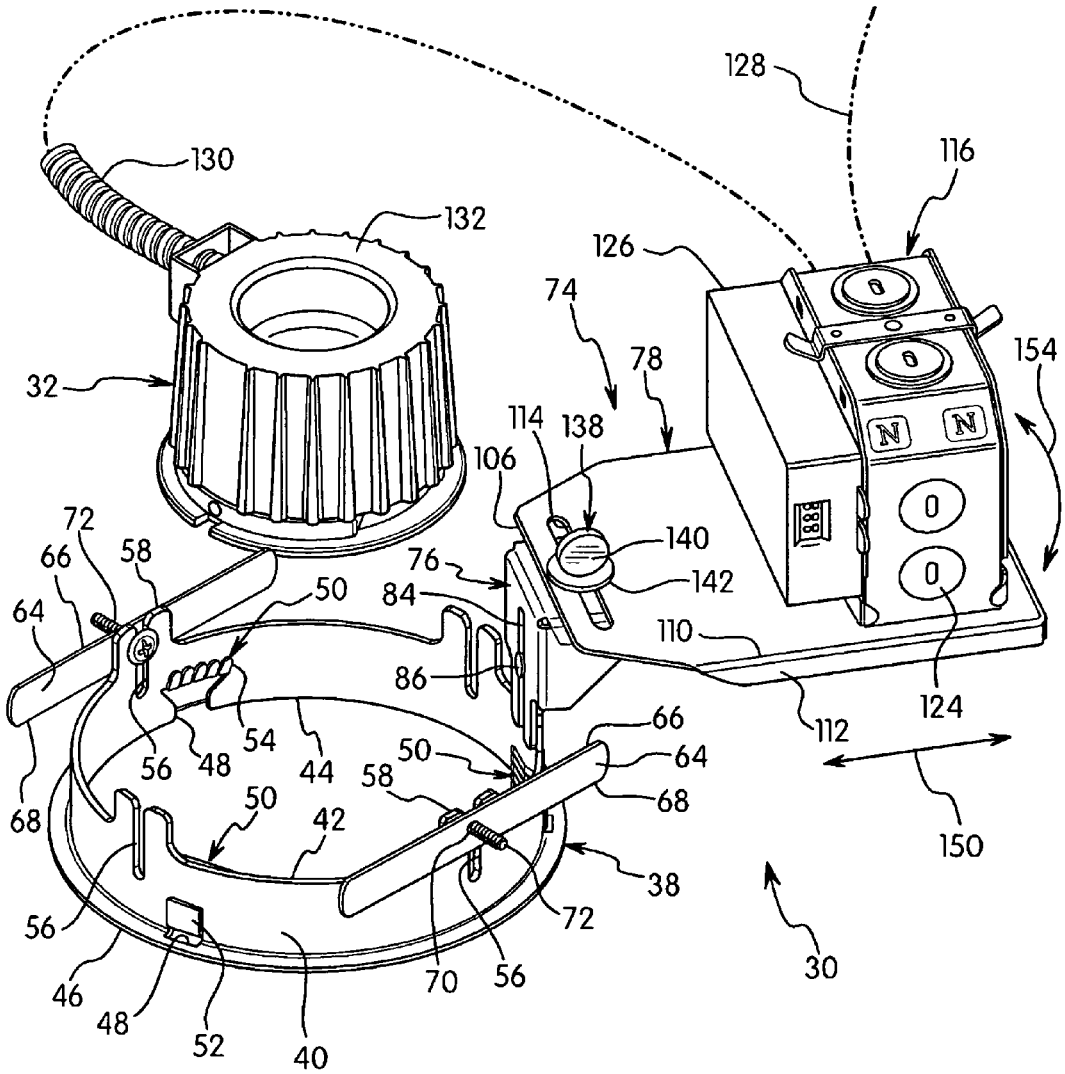
FIG. 2 is an enlarged perspective view of the retrofit lighting assembly of FIG. 1.

Referring to FIGS. 2 and 3, an elongated strip forming an attachment member 64 is coupled to the side wall 40 of mounting ring 38. Attachment member 64 has a longitudinal dimension with a top edge 66 and a bottom edge 68. In one embodiment of the invention, attachment member 64 is substantially straight with bottom edge 68 being substantially straight to engage the top surface of the plaster frame 20 or the top surface of the ceiling when a plaster frame is not used. In alternative embodiments, attachment members 64 can be curved outwardly away from the side wall 40 of mounting ring 38 or have ends angled downwardly to contact the plaster frame or ceiling.

Attachment member 64 has a longitudinal dimension to extend beyond the edges of the mounting ring 38 to contact the top surface of the plaster frame 12 and retain the mounting ring 38 in the opening 22. As shown in FIG. 3, two attachment members 64 are provided on opposite sides of mounting ring 38 although additional attachment members can be provided as needed. Each attachment member 64 includes a centrally located screw hole 70 for receiving a mounting screw 72. Hole 70 can be threaded to receive the respective screw 72. Alternatively, hole 70 can be a punched or cut hole and screw 70 can be a self tapping sheet metal type screw. Screws 70 are received in a respective slot 56 for vertical adjustment with respect to the ring 38. In a preferred embodiment, screws 72 extend through the slot 56 and are threaded into the screw hole 70 so that the head of the screw 72 is accessible through the central opening of the ring 38. This enables a screw driver or other tool to be positioned within the opening in the ring 38 to tighten the screw 72.

The ring 38 and attachment member 64 are preferably made of steel, aluminum or other metal and have a thickness sufficient to support the weight of the lighting assembly and couple to the plaster frame 12. In one embodiment, the attachment member 64 is a substantially flat planar member. In alternative embodiments, the attachment member can have the legs inclined in a downward direction with respect to the central portion so that the ends of the legs contact the top surface of the plaster frame.

An adjustable mounting bracket 74 is coupled to mounting ring 38 as shown in FIGS. 2 and 3. Mounting bracket 74 includes a bracket 76 and a base 78 for supporting an electrical junction box, ballast and other lighting components. The position of the mounting bracket 74 is adjustable with respect to the mounting ring 38.

Bracket 76 has a substantially L-shape with a first leg 80 and a second leg 82 extending substantially perpendicular to the first leg 80. The first leg 80 has a longitudinal dimension to allow vertical or axial adjustment with respect to mounting ring 38. As shown in FIG. 3, first leg 80 has a longitudinal slot 84 for receiving a locking screw 86. Screw 86 passes through the slot 84 and the aperture 62 in mounting flange 60 and is threaded into an attachment plate 88. Attachment plate 88 includes a threaded screw hole 90 for receiving screw 86. Hole 90 can be a threaded hole or a punched or cut hole for receiving a self threading screw 86. Attachment plate 88 includes flanges 92 extending perpendicular to the plane of attachment plate 88 for engaging the sides and the top edges of mounting flange 60 to prevent rotation of attachment plate 88 when screw 86 is rotated and tightened to fix the position of the first leg 80 to the mounting ring 38.

First leg 80 includes a brace 94 for supporting the second leg 82 and resisting deflection of the base 78 and the second leg 82 with respect to first leg 80. The second leg 82 has longitudinal side edges 96 with a downwardly extending flange 98 for coupling to the brace 94 by a screw, spot weld 100 or other fastening member. As shown in FIG. 3, second leg 82 has a longitudinal slot 102. In the embodiment illustrated, the slot 102 extends in a direction perpendicular to the plane of first leg 80 so that the slot extends radially outward from the ring 38 when the mounting bracket 74 is attached to the ring 38. The L-shaped mounting bracket 76 is coupled to the inner surface of the mounting ring 38 by passing the screw 86 through the slot 84 and hole 90 so that the second leg 82 extends radially outward with respect to mounting ring 38. The axial position of the L-shaped bracket 76 is adjusted to the selected position with respect to the ring 38 and screw 86 is tightened to fix the position of the L-shaped bracket 76 to the mounting ring 38. The slot 84 in the first leg 80 allows a vertical adjustment with respect to the ring 38 and the ceiling.

Base 78 as shown in FIG. 3 has a substantially planar body portion 104 with a first end 106, an opposite second end 108 and opposite side edges 110. Downwardly turned flanges 112 extend from side edges 110 to strengthen the body 104 and prevent flexing or bending during use.

An elongated slot 114 extends between the opposite side edges 110 adjacent to the first end 106. Preferably, slot 114 extends substantially parallel to first end 106 and is positioned adjacent the first end 106.

As shown in FIG. 3, base 78 supports a retrofit electrical junction box 116. In the embodiment illustrated, electrical junction box 116 is coupled to the base 78 by tabs 118 that extend through openings 120 which are then bent or welded to fix the electrical junction box 116 to the base 78. Other methods of attaching electrical junction box 116 to base 78 can also be used. The electrical junction box 116 includes removable side walls 122 for accessing the box and knock outs 124 for receiving suitable wiring. A ballast 126 is attached to the electrical junction box 116 and supported by the base 78. A power cable 128 is connected to the junction box 116 and an electrical cable 130 is connected between the junction box 116 and the luminaire 36. The lamp socket 32 of the luminaire as shown in FIG. 3 includes a housing 132 and a socket 134 coupled to the housing 132 by screws 136.

Base 78 is coupled to the L-shaped bracket 78 by a thumb screw 138. Screw 138 has a flat head 140 for manual turning of the screw. Screw 138 extends through a washer 142, the elongated slot 114 of body 104, and elongated slot 84 in the L-shaped mounting bracket 76 and is threaded into a locking plate 144 positioned below the L-shaped mounting bracket 76. Locking plate 144 as shown in FIG. 3 has a substantially square configuration with a center hole 146. Preferably, hole 146 is threaded to receive the screw 138. Locking plate 146 has a dimension to fit within the flanges 98 to prevent rotation of the locking plate 144 when the screw 138 is tightened.

As shown in the drawings, lighting assembly 10 is adapted for retrofitting an existing luminaire in the plaster frame 12. The existing luminaire can be removed or moved to one side of the plaster frame within the space above the ceiling and the plaster frame. The power connection in the ceiling is pulled downwardly through the opening 22 and connected to the electrical junction box 116. The electrical wiring 130 is then fed from the electrical junction box 116 to the retrofit luminaire 36. Typically, it is not necessary to remove the existing electrical box and lamp socket provided the components can be moved to a location within the ceiling to avoid interference with the retrofit assembly. The retrofit lighting assembly 10 is then positioned within the opening 22 of the plaster frame 12 by inserting the junction box 116 and the mounting bracket 74 through the opening and positioning the mounting ring 38 within the opening 22.

Figure 4:
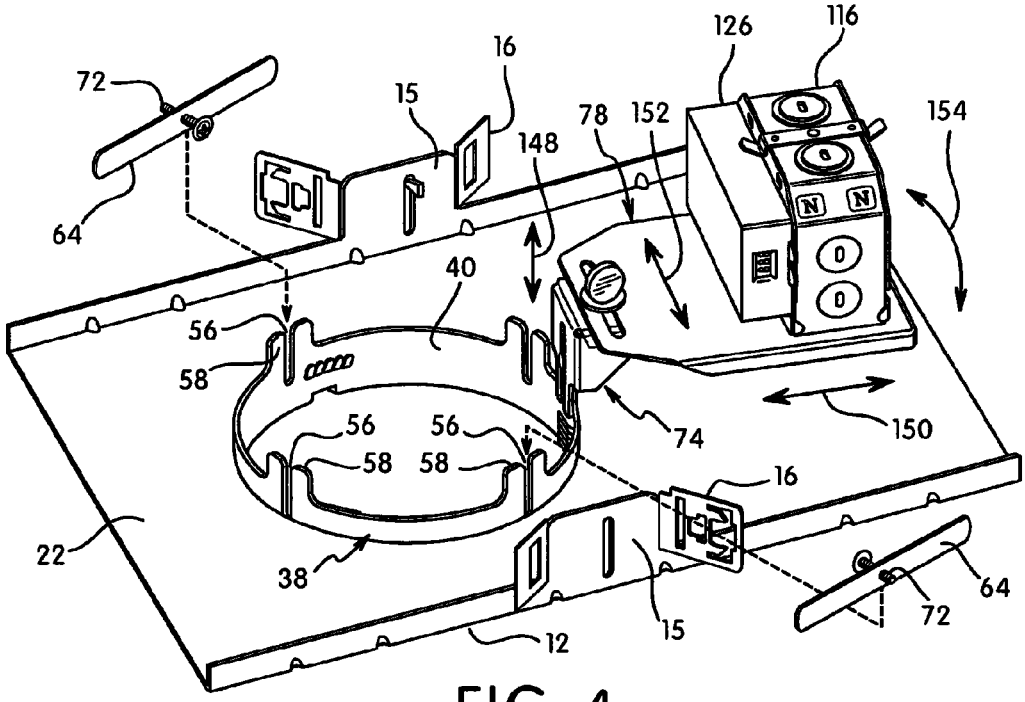
FIG. 4 is a perspective view of the retrofit lighting assembly inserted into the opening of a plaster frame showing the coupling of the attachment member to the ring.
Figure 5:
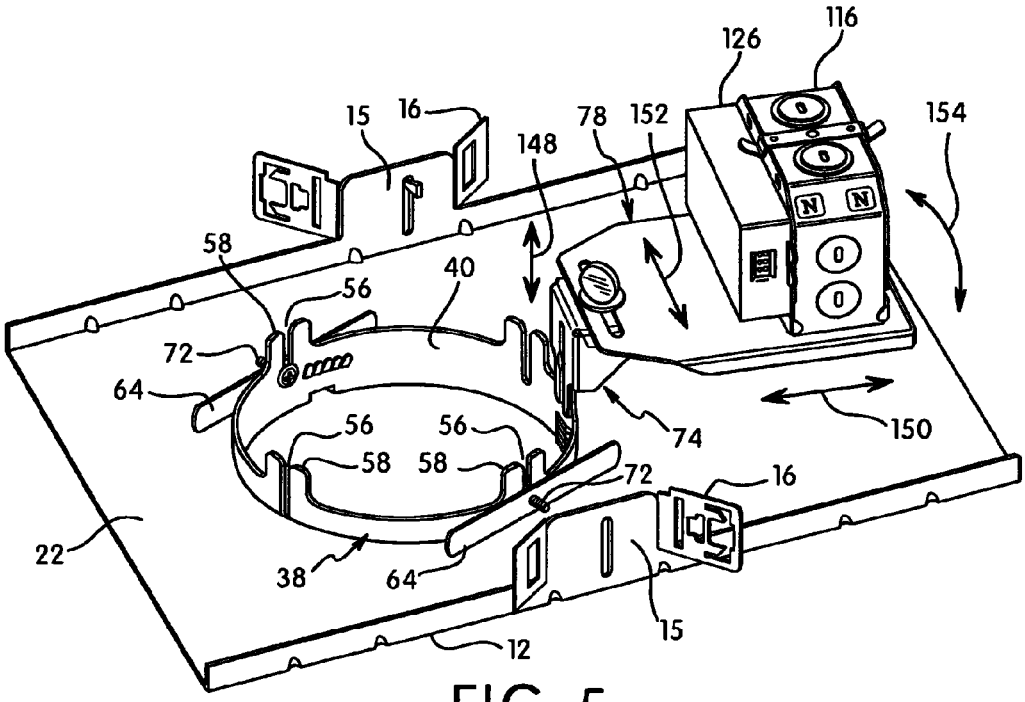
FIG. 5 is a perspective view of the retrofit lighting apparatus mounted to the ceiling pan and the directional movement of the electrical wall.
Figure 6:
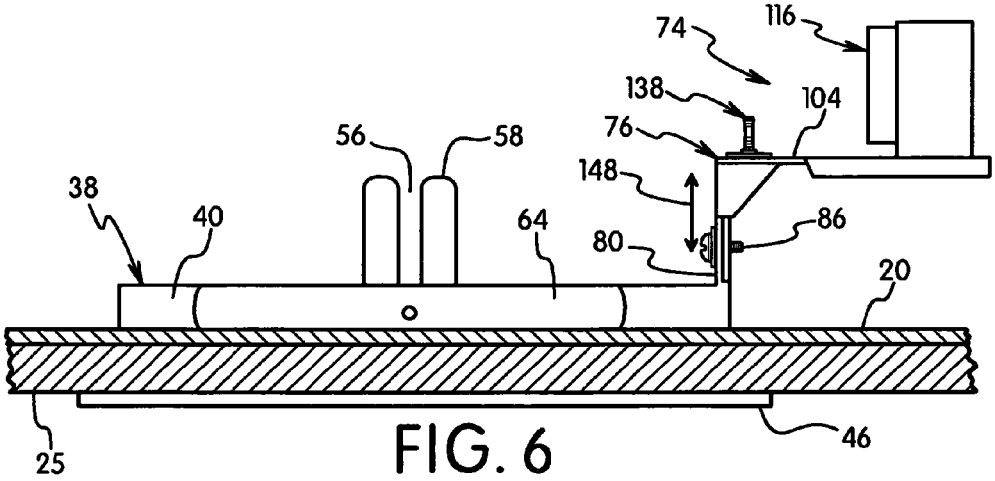
FIG. 6 is a side view of the retrofit lighting assembly mounted to the ceiling pan.
Figure 7:
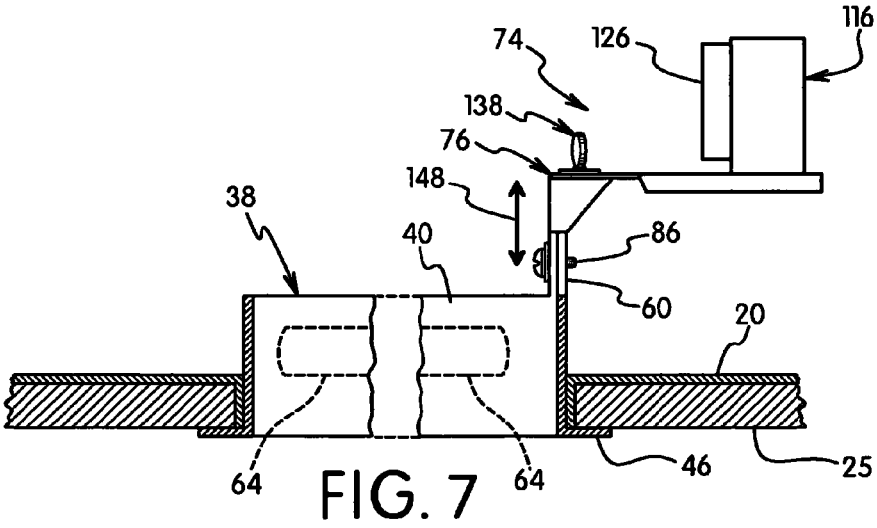
FIG. 7 is a partial cross-sectional side view of the retrofit lighting assembly.

Attachment member 64 and the corresponding screw 72 are positioned within the elongated slots 56 as shown in FIGS. 4 and 5. The attachment member 64 is drawn downwardly against the top surface of the plaster frame while pushing the mounting ring 38 upwardly into engagement with the surface of the ceiling and the collar 24 of the plaster frame 20 as shown in FIGS. 6 and 7. The screw 72 is then tightening to secure the attachment member and retain the mounting ring within the opening of the plaster frame. The mounting ring 38 can be rotated within the opening in the plaster frame to the desired position to avoid obstructions in the ceiling such as the existing luminaire and electrical box shown in FIG. 1.

Figure 8:
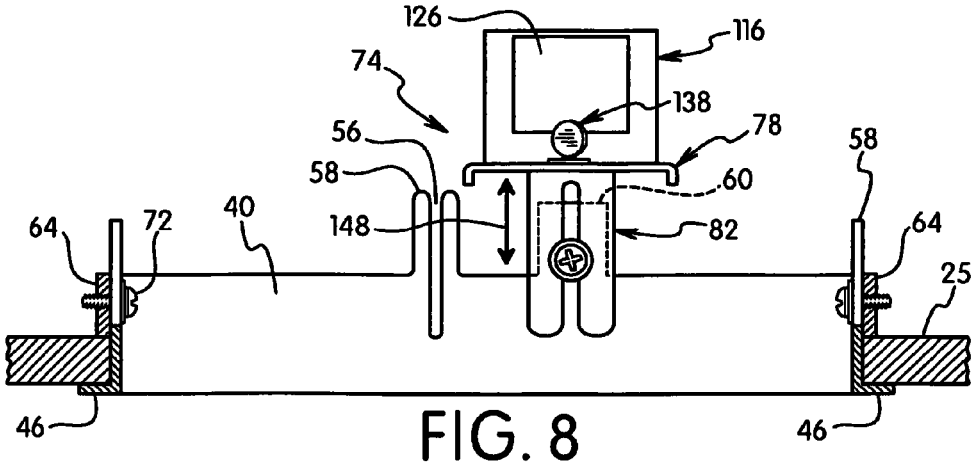
FIG. 8 is a cross-sectional side view of the retrofit assembly attached to the ceiling in an alternative embodiment of the invention.
Figure 9:
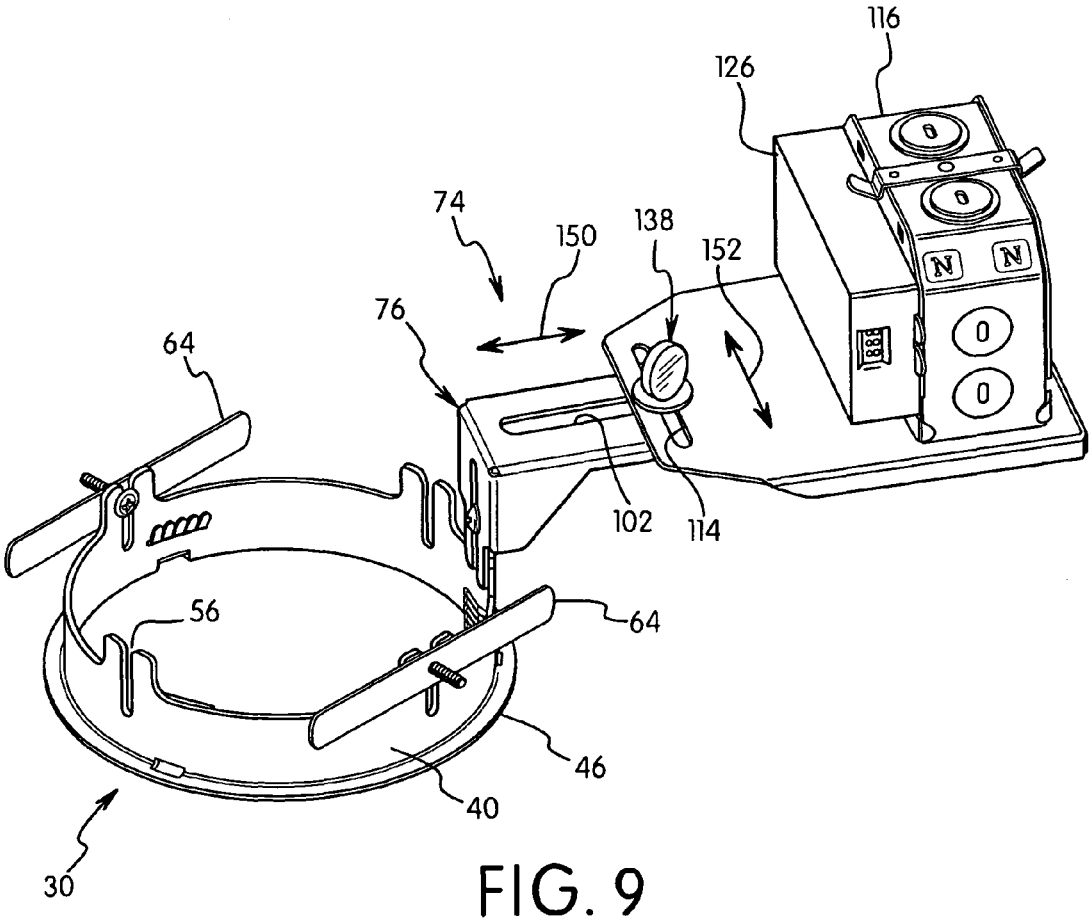
FIG. 9 is a perspective view of the retrofit lighting assembly of FIG. 1 showing the adjustable position of the junction box.

The adjustable mounting bracket 74 can be adjusted in various positions to allow the junction box 116 to avoid obstructions in the ceiling. Mounting bracket 74 can be adjusted in a vertical direction indicated by arrow 148 to adjust the height of base 78 and electrical junction box 116 with respect to the top surface of the plaster frame as shown in FIG. 5 and FIG. 8. The screw 86 can then be tightened to fix the vertical height of base 78. Thumb screw 138 allows rotational and sliding movement of base 78 with respect to L-shaped bracket 76 to position the electrical box 116 in a selected position. Base 78 can slide in a radial direction along slot 102 and in a tangential direction along slot 114 while allowing rotational movement with respect to L-shaped bracket 76. As shown in FIG. 5, base 78 can slide in the radial direction indicated by arrow 150 and in the tangential direction indicated by arrow 152 and in a rotational direction indicated by arrow 154.

Figure 10:
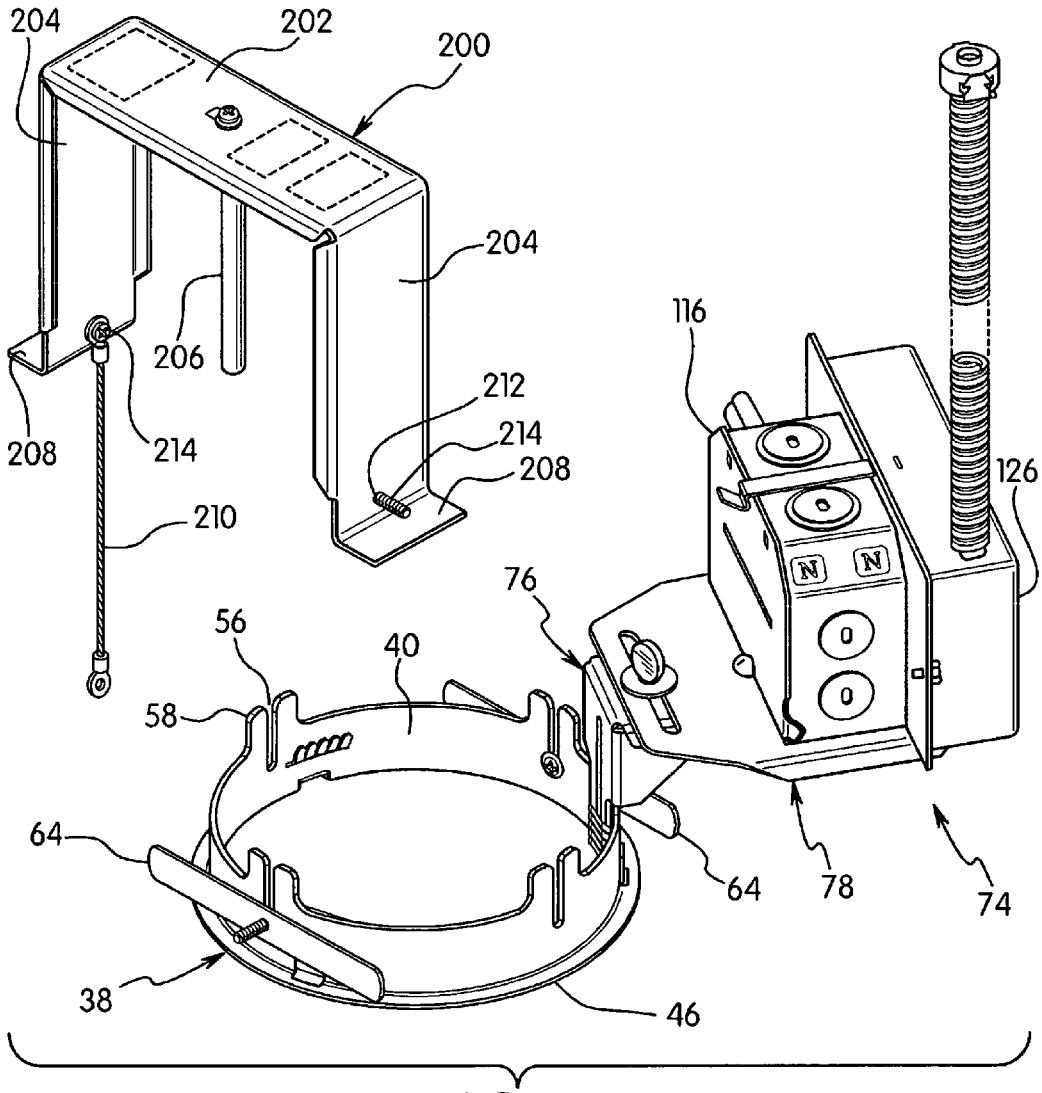
FIG. 10 is a perspective view of the retrofit assembly showing the lamp support bracket.
Figure 11:
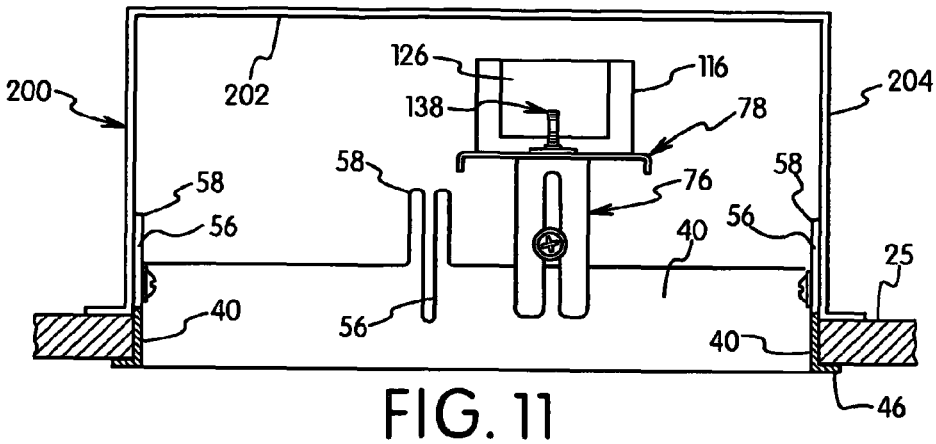
FIG. 11 is a cross-sectional side view of the assembly of FIG. 10 attached to the opening in a ceiling.

In other embodiments shown in FIGS. 10 and 11, a support bracket 200 is provided for supporting a luminaire and coupling the luminaire to the ring 38. The luminaire (not shown in FIGS. 10 and 11) attached to support bracket 200 can be an LED module. Support bracket 200 in the embodiment shown has a top plate 202 and downwardly extending legs 204 at each end. Top plate 202 has an arm 206 extending downwardly for supporting the luminaire. A base 208 extends outwardly from the lower end of each leg 204.

Support bracket 200 is constructed to attach to the mounting ring 38 and to assist in coupling mounting ring 38 to the plaster frame or ceiling. Each base 208 has a dimension to engage the top surface of the ceiling as shown in FIG. 11 or the plaster frame when the plaster frame is present. As shown in FIG. 10, support bracket 200 is tethered to the mounting ring 38 by a cord 210. Support bracket 200 is inserted through the opening in the ceiling and positioned with the bases 208 spanning the opening. The mounting ring 38 is then fitted through the opening and secured to the support bracket. Each leg 208 has a threaded aperture 212 for receiving a screw 214. As shown in FIG. 11, each arm 206 and base 208 is positioned on the outer circumference of the mounting ring 38. Screws 214 pass through a slot 56 into the threaded aperture 212 and tightened to attach the support bracket 200 and the mounting ring together.

Figure 12:
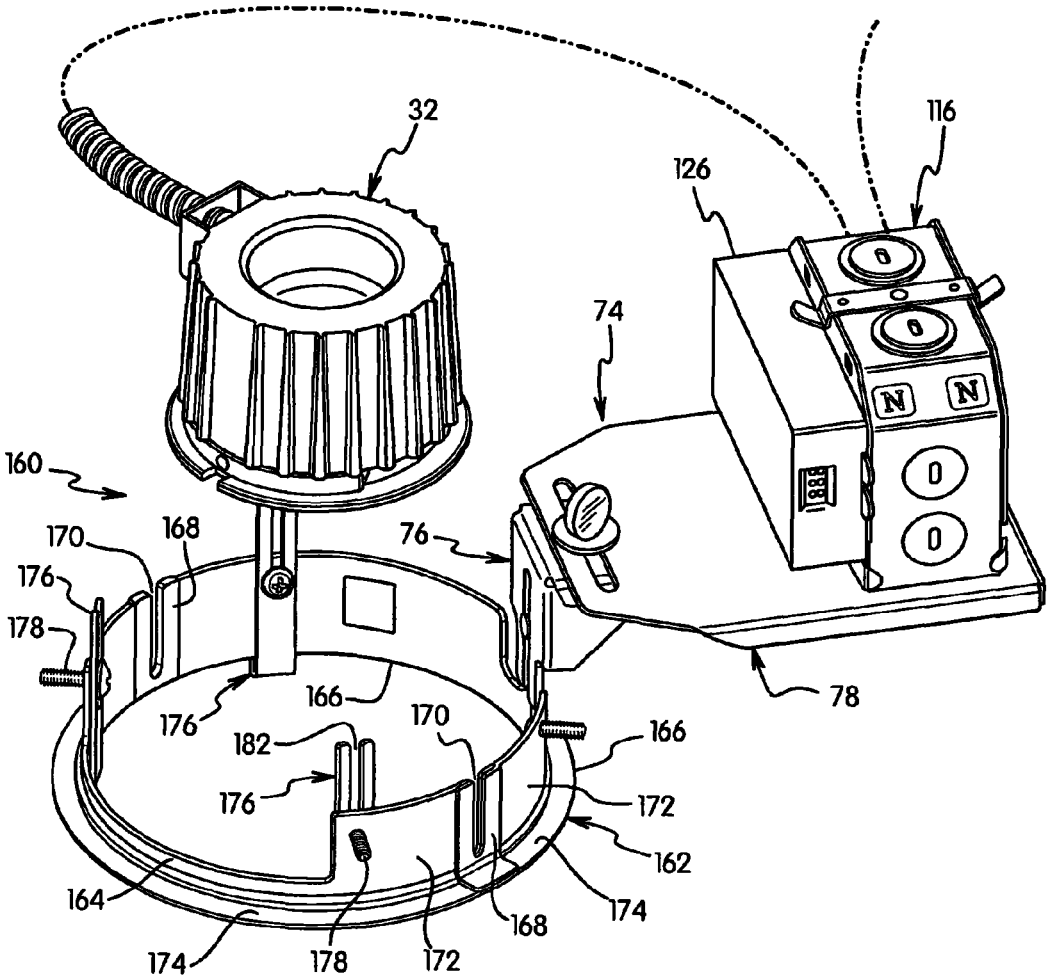
FIG. 12 is a perspective view of the retrofit assembly in a second embodiment of the invention.

In a second embodiment shown in FIGS. 12-16, the retrofit lighting assembly 160 includes a mounting ring 162 formed from a first semi-circular ring portion 164 and a second semi-circular ring portion 166. The mounting assembly 30 for the electrical junction box and the socket for the retrofit luminaire are substantially the same as in the previous embodiment. Thus, the components of the mounting assembly 30 are shown in FIG. 12 by the same reference numbers.

Figure 13:
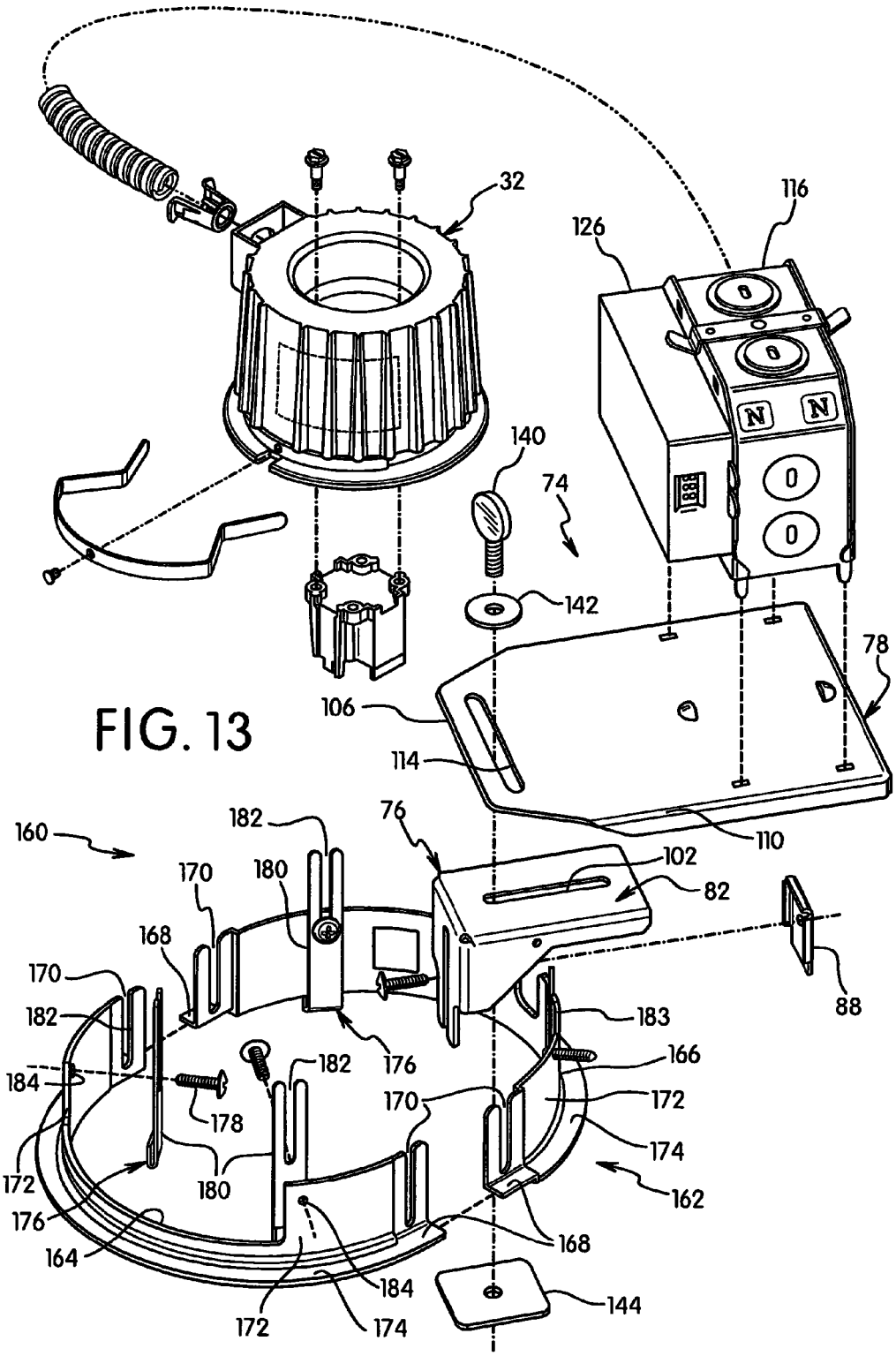
FIG. 13 is an exploded view of the retrofit lighting assembly of FIG. 9.

As shown in FIG. 12, first portion 164 and second portion 166 have a semicircular shape that are joined together at respective ends 168 in an overlapping manner. The overlapping ends can be coupled together by a screw or other fastener although it is not essential that the ends be mechanically coupled together. As shown in FIG. 13, second ring portion 166 has a recessed area 167 at the ends 168 to receive the ends of the first ring portion 164. The recessed areas 167 are formed to enable the side walls 172 from the first and second ring portions 164 and 166 to align when coupled together.

A substantially U-shaped slot 170 is provided at each end 168 which are aligned when assembled together as shown in FIG. 11 with the ends of the first portion 164 and the second portion 166 overlapping. Each portion 164 and 166 include a side wall 172 extending in an axial direction with respect to the ring 162 and an outwardly extending radial flange 174. A plurality of mounting clips 176 are secured to the inner surface of side wall 72 by screws 178. Each clip 176 has a body portion 180 and a U-shaped slot 182 at an upper end. The screw 178 passes through the slot 182 and is threaded into a hole 184 in the side wall 172 of the ring 162. A mounting bracket 76 is coupled to a mounting flange 183 for allowing vertical adjustment of the mounting assembly with respect to the ring 162 as in the previous embodiment.

Figure 14:
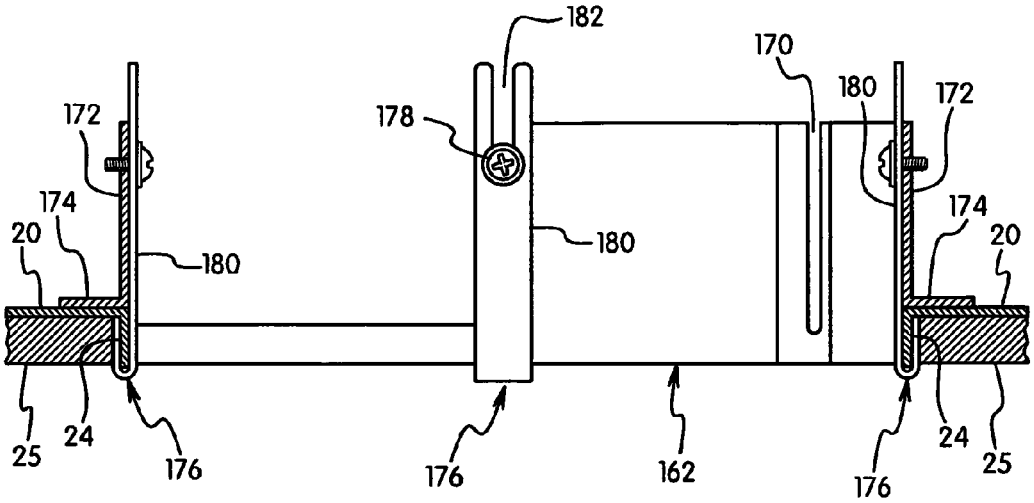
FIG. 14 is a cross-sectional side view of the retrofit assembly coupled to the plaster frame.
Figure 15:
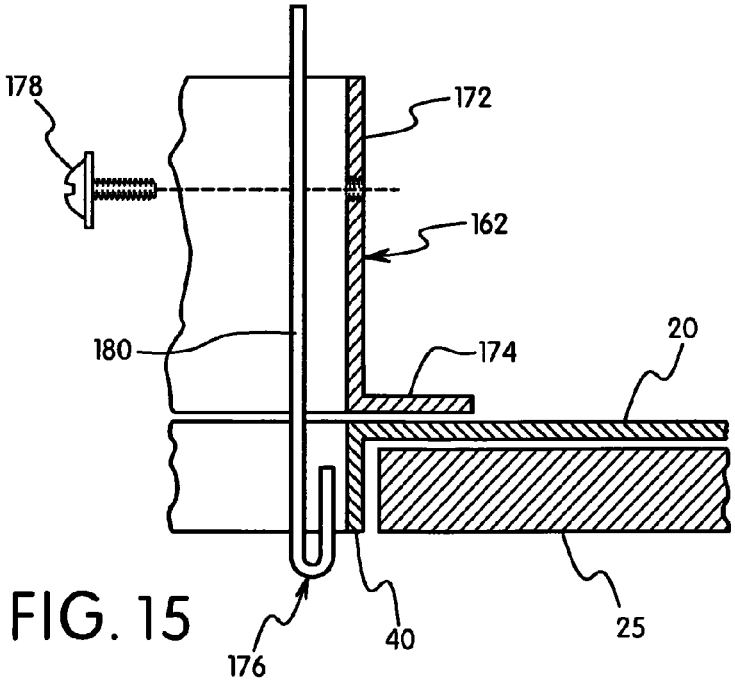
FIG. 15 is a partial cross-sectional side view of the retrofit assembly of FIG. 12 showing the assembly being attached to the plaster frame.

Each portion 164 and 166 of ring 162 can be attached independently to the plaster frame by the clips 176. The ring portions 164 and 166 are inserted through the opening in the ceiling or the opening in the plaster frame and positioned along the top edge of the opening as shown in FIGS. 14 and 15. The ends of the ring portions are coupled together to form a continuous ring. The clips 176 are hooked onto the bottom edge of the flange 24 of the plaster frame as shown in FIG. 14. The attaching screw 178 is threaded into the threaded hole 184. The clips 176 are aligned with the screws 178 so that the screws slide through the slot 182 into position. The screws are then tightened to secure the ring to the plaster frame. Preferably, the screws 198 are positioned to be accessible through the opening in the plaster frame.

Figure 16:
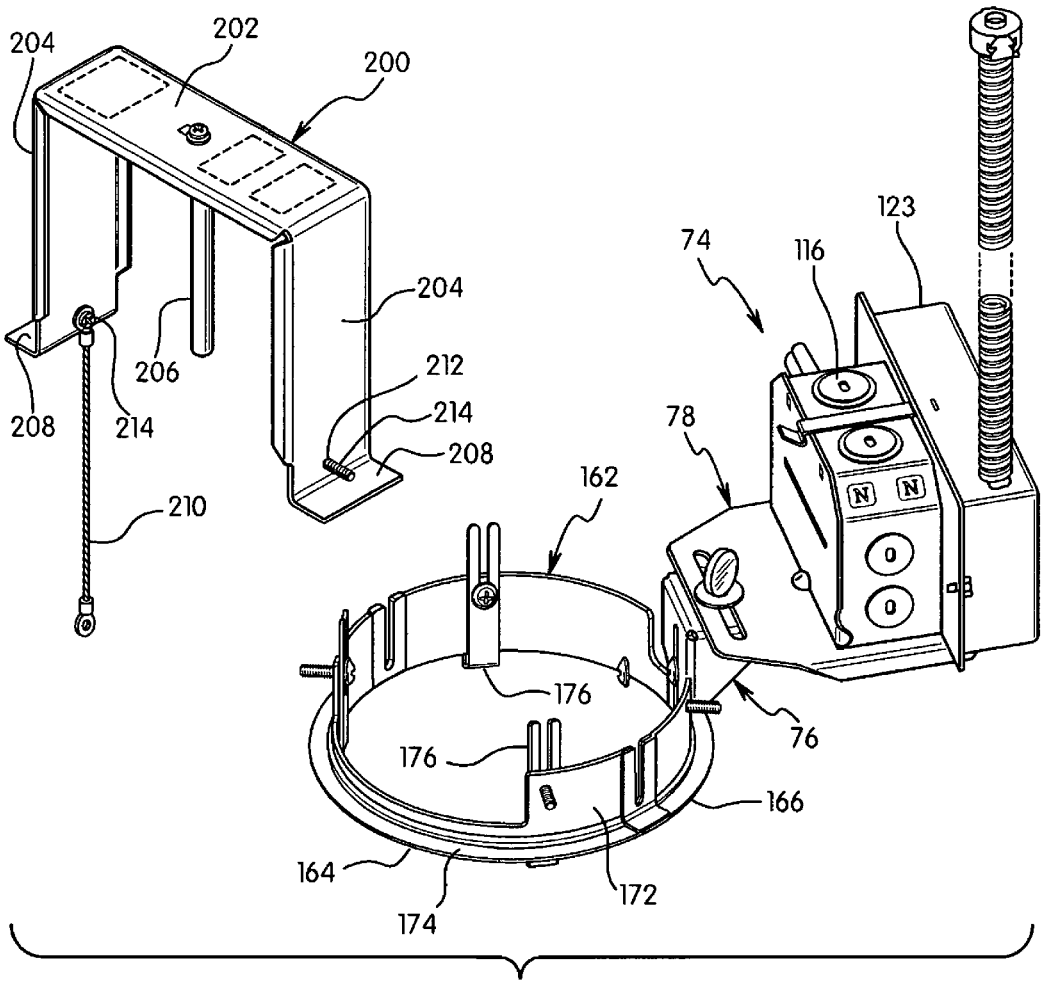
FIG. 16 is a perspective view of the retrofit assembly of FIG. 12 showing the supporting bracket for the lamp assembly.

In the embodiment shown in FIG. 16, a mounting bracket 200 as in the previous embodiment is coupled to ring portions 164 and 166. The screws 214 extend through the overlapping slots of the ring portions to couple the bracket to the ring and couple the ring portions together. The two-part ring is particularly suitable for lighting fixtures where it is necessary to attach the mounting ring to the top surface of the mounting frame or plaster frame.

The power cable is attached to the junction box and the position of the junction box is adjusted by the adjustable mounting assembly as in the previous embodiment. The power connection from the junction box is fed to the retrofit socket. A retrofit light source such as an LED array is coupled to the socket. A reflector is then coupled to the socket and the reflector is then attached to the ring 162 by clips or by the support bracket.

While various embodiments have been chosen to illustrate the invention, it will be understood by those skilled in the art that various changes and modifications can be made without departing from the scope of the invention as described in the appended claims.

What is claimed is:

1. A lighting fixture assembly comprising:

a mounting frame adapted to be coupled to a ceiling support, said mounting frame having a downwardly facing bottom portion with an opening;

a luminaire mounted with respect to said mounting frame for projecting light downwardly through said opening; and an electrical box assembly including an electrical box and an adjustable mounting bracket, said electrical box assembly having a dimension adapted to pass through said opening and to mount to said mounting frame;

said mounting bracket having a base supporting said electrical box, said base and electrical box being independently adjustable in a first vertical direction with respect to a plane of said bottom portion and being adjustable in a second direction transverse to said first direction.

2. The lighting fixture assembly of claim 1, further comprising a removable mounting ring coupled to the frame and having an annular side wall with a top end, a bottom end and an outwardly extending flange at said bottom end, and where said electrical box assembly is coupled directly to said mounting ring.

3. The lighting fixture assembly of claim 2, wherein said mounting bracket is coupled to said side wall of said mounting ring and is adjustable in an axial direction with respect to said mounting ring.

4. The lighting fixture assembly of claim 3, further comprising a fastener for coupling said mounting bracket to said mounting ring, and where said fastener is accessible through said ring.

5. The lighting fixture assembly of claim 2, wherein said electrical box is rotatably mounted to said mounting bracket about an axis parallel to an axis of said opening.

6. The lighting fixture assembly of claim 5, wherein said mounting bracket includes a base coupled directly to said side wall of said mounting ring, and where said electrical box is coupled to said base.

7. The lighting fixture assembly of claim 6, wherein said base is adjustable in an axial direction with respect to said mounting ring.

8. The lighting fixture assembly of claim 6, wherein said electrical box is adjustable in a radial direction with respect to said opening in said mounting frame.

9. The lighting fixture assembly of claim 8, wherein said electrical box includes a plate having an elongated slot and a fastener extending through said slot and coupled to said base, whereby said electrical box is pivotable and slidable with respect to said base.

10. A lighting fixture assembly comprising:

a mounting frame adapted to be coupled to a support and having an opening therein;

a luminaire mounted with respect to said mounting frame for projecting light through said opening;

an adjustable mounting bracket coupled to said mounting frame; and an electrical box coupled to said adjustable bracket, said electrical box and adjustable bracket being adapted for adjusting the position of said electrical box with respect to said opening in a first radial direction extending away from said opening in a plane of said mounting frame and in a direction substantially perpendicular to said first direction.

11. The lighting fixture assembly of claim 10, wherein said mounting bracket has a substantially L-shape with a first leg coupled to said mounting frame and adjustable in a direction perpendicular to said support, and a second leg extending perpendicular from said first leg, said electrical box being coupled to said second leg.

12. The lighting fixture assembly of claim 11, wherein said electrical box is pivotally coupled to said second leg about an axis perpendicular to said second leg.

13. The lighting fixture assembly of claim 11, wherein said electrical box is slidably connected to said second leg and adjustable in a linear direction with respect to said second leg.

14. The lighting fixture assembly of claim 13, wherein said electrical box is pivotally connected to said second leg.

15. The lighting fixture assembly of claim 14, wherein said electrical box includes a plate having a first elongated slot and a fastener extending through said slot and coupled to said second leg.

16. The lighting fixture assembly of claim 15, wherein said second leg includes a second elongated slot and said fastener is received in said second slot.

17. A lighting fixture assembly, comprising:

a mounting frame adapted to be coupled to a support, said mounting frame having an opening;

a luminaire mounted with respect to said mounting frame and positioned to project light downwardly through said opening; and an electrical box assembly adapted for attachment to said mounting frame, said electrical box assembly having an electrical box being adapted to be pivotally adjustable about an axis perpendicular to a plane of said mounting frame.

18. The lighting fixture assembly of claim 17, further comprising a mounting ring having an annular side wall received in said opening in said mounting frame, and said electrical box assembly being coupled to said mounting ring.

19. The lighting fixture assembly of claim 18, further comprising a mounting bracket coupled to said mounting ring and said electrical box being coupled to said mounting bracket, said electrical box being adjustable in an axial first direction and in a radial second direction with respect to a center axis of said opening in said mounting frame.

20. The lighting fixture assembly of claim 19, wherein said electrical box is adjustable in a third direction independent of said first direction and second direction.

21. The lighting fixture assembly of claim 19, wherein said electrical box is pivotally connected to said mounting bracket.

22. The lighting fixture assembly of claim 19, wherein said electrical box is slidable in a linear direction and rotatable with respect to said mounting bracket.

23. A method of retrofitting a lighting assembly having a mounting frame coupled to a support and a luminaire for projecting light through an opening in the mounting frame, the method comprising the steps of:

removing the luminaire from the mounting frame;

inserting an electrical box assembly through the opening in the mounting frame and attaching the electrical box assembly to the mounting frame, the electrical box assembly including a mounting bracket and an electrical box coupled to the mounting bracket;

adjusting the height and angular position of the electrical box about a vertical axis in a selected position with respect to the mounting frame; and mounting a replacement luminaire above the mounting frame and operatively connecting the replacement luminaire to the electrical box.

24. The method of claim 23, wherein said mounting bracket is coupled to a mounting ring, and said method further comprises coupling said mounting ring to said mounting frame in said opening.

25. The method of claim 24, further comprising adjusting the axial position of said electrical box with respect to a center axis of said ring; and adjusting the angular position of said electrical box with respect to said center axis.

26. The lighting fixture assembly of claim 10, wherein said electrical box is pivotally adjustable about an axis parallel to an axis of said opening in said mounting frame.

27. A lighting fixture assembly comprising:

a mounting ring rotatably coupled to said mounting frame, and being aligned with said opening;

a luminaire mounted with respect to said mounting frame for projecting light downwardly through said opening in said mounting frame and mounting ring; and an electrical box assembly coupled to said mounting ring, whereby said electrical box assembly is adjustable about an axis parallel to a center axis of said opening and mounting ring.

28. The lighting assembly of claim 27, wherein said electrical box assembly comprises a mounting bracket coupled to said ring and being adjustably positioned in an axial direction with respect to said ring.

29. The lighting assembly of claim 27, wherein said electrical box assembly further comprises a base having an electrical box coupled thereto and where said base and electrical box are pivotally adjustable about said axis parallel to a longitudinal axis of said ring.

30. The lighting assembly of claim 27, wherein said electrical box assembly is adjustable with respect to said mounting frame about a first center axis of said ring by rotational adjustment of said ring, and adjustable with respect to said ring about a second axis parallel to said first axis.

31. The lighting assembly of claim 30, wherein said electrical box assembly further comprises a mounting bracket coupled to said mounting ring and an electrical box pivotally coupled to said mounting bracket about an axis parallel to a center axis of said mounting ring.

32. The lighting assembly of claim 27, wherein said electrical box assembly further comprises a mounting bracket coupled to said mounting ring and an electrical box coupled to said mounting bracket, said electrical box being slidably adjustable with respect to said mounting bracket in a first linear direction with respect to said mounting bracket.

33. The lighting assembly of claim 32, wherein said electrical box is adjustable with respect to said mounting bracket in a second linear direction with respect to said mounting bracket.

34. The lighting assembly of claim 33, wherein said electrical box is pivotally coupled to said mounting bracket and pivotable about an axis.

35. The lighting assembly of claim 27, wherein said mounting ring is received within said opening in said mounting frame, said ring having at least one attachment member for contacting a top face of said mounting frame.

36. The lighting assembly of claim 27, further comprising an attachment member coupled to said mounting ring and extending through said opening in said mounting frame for contacting a lower surface of said mounting frame.

37. The lighting assembly of claim 36, wherein said mounting frame includes an annular lip surrounding said opening and where said attachment member couples to said annular lip.

* * * * *